US006012687A

United States Patent [19]

Head

[11] Patent Number: 6,012,687

[45] Date of Patent: Jan. 11, 2000

[54] PLASTIC BAG HOLDING DEVICE

[76] Inventor: William M. Head, 22963 Cordoba Pl., Salinas, Calif. 93908

[21] Appl. No.: 09/130,442

[22] Filed: Aug. 6, 1998

[51] Int. Cl.[7] ..... B65B 67/04; B65B 67/12

[52] U.S. Cl. ..... 248/100; 248/95; 248/99

[58] Field of Search ..... 248/95, 97, 99, 248/100; 211/85.15; 273/248, 236

[56] References Cited

U.S. PATENT DOCUMENTS

| | | | |
|---|---|---|---|
| 746,988 | 12/1903 | Olin | 248/97 |
| 906,794 | 12/1908 | Hall | 248/100 |
| 2,451,829 | 10/1948 | Hightower | 248/100 |
| 5,090,106 | 2/1992 | Fink | 29/525 |
| 5,188,244 | 2/1993 | Hollstegge | 211/71 |
| 5,653,443 | 8/1997 | Ervin | 273/248 |

*Primary Examiner*—Derek J. Berger
*Assistant Examiner*—David Heisey

[57] ABSTRACT

A new plastic bag holding device for holding open a plastic bag while it is being filled. The inventive device includes a base and a plurality of elongate pegs. The top of the base has a plurality of spaced apart sockets extending into the interior of the base. One of the ends of each peg is insertable into a socket such that the pegs are upwardly extended from the top of the base. The base also has a number of storage compartments in the interior of the base for storing the pegs when not in use.

7 Claims, 3 Drawing Sheets

PLASTIC BAG HOLDING DEVICE

BACKGROUND OF THE INVENTION

1. Field of the Invention

The present invention relates to plastic bag holding devices and more particularly pertains to a new plastic bag holding device for holding open a plastic bag while it is being filled.

2. Description of the Prior Art

The use of plastic bag holding devices is known in the prior art. More specifically, plastic bag holding devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art plastic bag holding devices include U.S. Pat. No. 5,188,244; U.S. Pat. No. 5,060,893; U.S. Pat. No. 4,248,278; U.S. Pat. No. 3,866,872; U.S. Pat. No. 4,874,141; and U.S. Pat. No. Des. 353,695.

While these devices fulfill their respective, particular objectives and requirements, the aforementioned patents do not disclose a new plastic bag holding device. The inventive device includes a base and a plurality of elongate pegs. The top of the base has a plurality of spaced apart sockets extending into the interior of the base. One of the ends of each peg is insertable into a socket such that the pegs are upwardly extended from the top of the base. The base also has a number of storage compartments in the interior of the base for storing the pegs when not in use.

In these respects, the plastic bag holding device according to the present invention substantially departs from the conventional concepts and designs of the prior art, and in so doing provides an apparatus primarily developed for the purpose of holding open a plastic bag while it is being filled.

SUMMARY OF THE INVENTION

In view of the foregoing disadvantages inherent in the known types of plastic bag holding devices now present in the prior art, the present invention provides a new plastic bag holding device construction wherein the same can be utilized for holding open a plastic bag while it is being filled.

The general purpose of the present invention, which will be described subsequently in greater detail, is to provide a new plastic bag holding device apparatus and method which has many of the advantages of the plastic bag holding devices mentioned heretofore and many novel features that result in a new plastic bag holding device which is not anticipated, rendered obvious, suggested, or even implied by any of the prior art plastic bag holding devices, either alone or in any combination thereof.

To attain this, the present invention generally comprises a base and a plurality of elongate pegs. The top of the base has a plurality of spaced apart sockets extending into the interior of the base. One of the ends of each peg is insertable into a socket such that the pegs are upwardly extended from the top of the base. The base also has a number of storage compartments in the interior of the base for storing the pegs when not in use.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein arc for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new plastic bag holding device apparatus and method which has many of the advantages of the plastic bag holding devices mentioned heretofore and many novel features that result in a new plastic bag holding device which is not anticipated, rendered obvious, suggested, or even implied by any of the prior art plastic bag holding devices, either alone or in any combination thereof.

It is another object of the present invention to provide a new plastic bag holding device which may be easily and efficiently manufactured and marketed.

It is a further object of the present invention to provide a new plastic bag holding device which is of a durable and reliable construction.

An even further object of the present invention is to provide a new plastic bag holding device which is susceptible of a low cost of manufacture with regard to both materials and labor, and which accordingly is then susceptible of low prices of sale to the consuming public, thereby making such plastic bag holding device economically available to the buying public.

Still yet another object of the present invention is to provide a new plastic bag holding device which provides in the apparatuses and methods of the prior art some of the advantages thereof, while simultaneously overcoming some of the disadvantages normally associated therewith.

Still another object of the present invention is to provide a new plastic bag holding device for holding open a plastic bag while it is being filled.

Yet another object of the present invention is to provide a new plastic bag holding device which includes a base and a plurality of elongate pegs. The top of the base has a plurality of spaced apart sockets extending into the interior of the base. One of the ends of each peg is insertable into a socket such that the pegs are upwardly extended from the top of the base. The base also has a number of storage compartments in the interior of the base for storing the pegs when not in use.

Still yet another object of the present invention is to provide a new plastic bag holding device that allows an easy and neat means of filling of various sizes of plastic freezer bags.

Even still another object of the present invention is to provide a new plastic bag holding device that is collapsible for convenient storage when not in use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
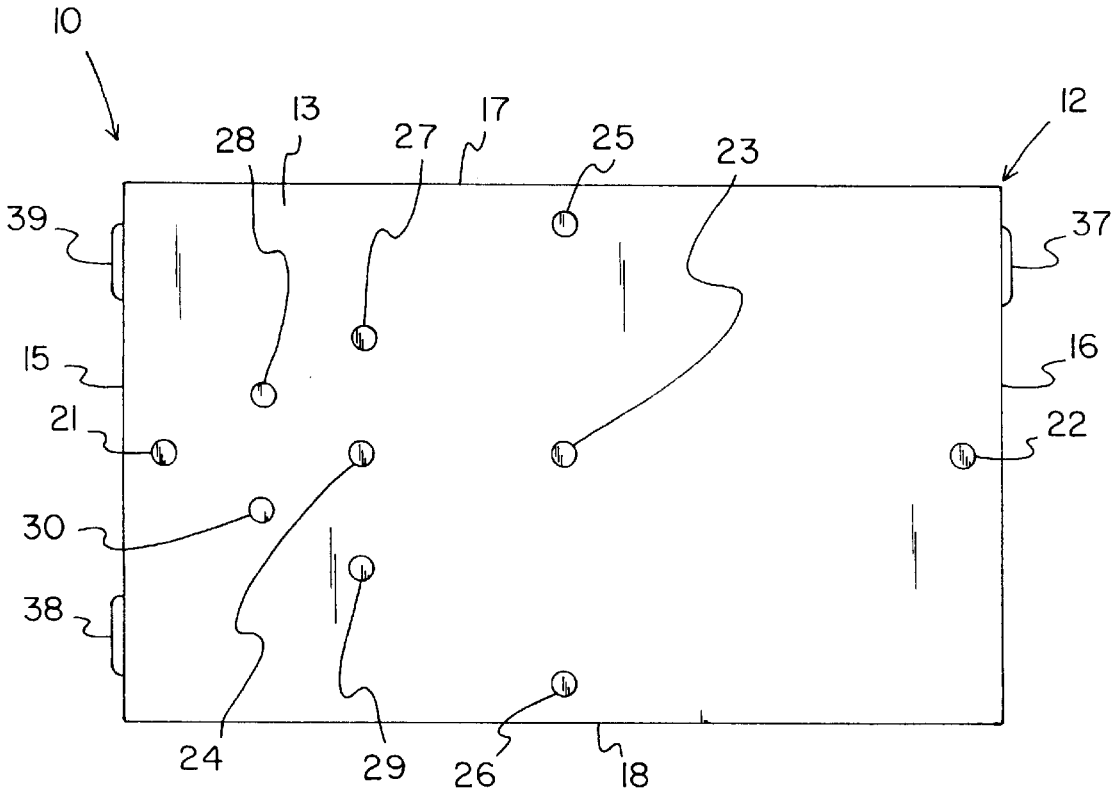
FIG. 1 is a schematic top view of a new plastic bag holding device according to the present invention.
Figure 2:
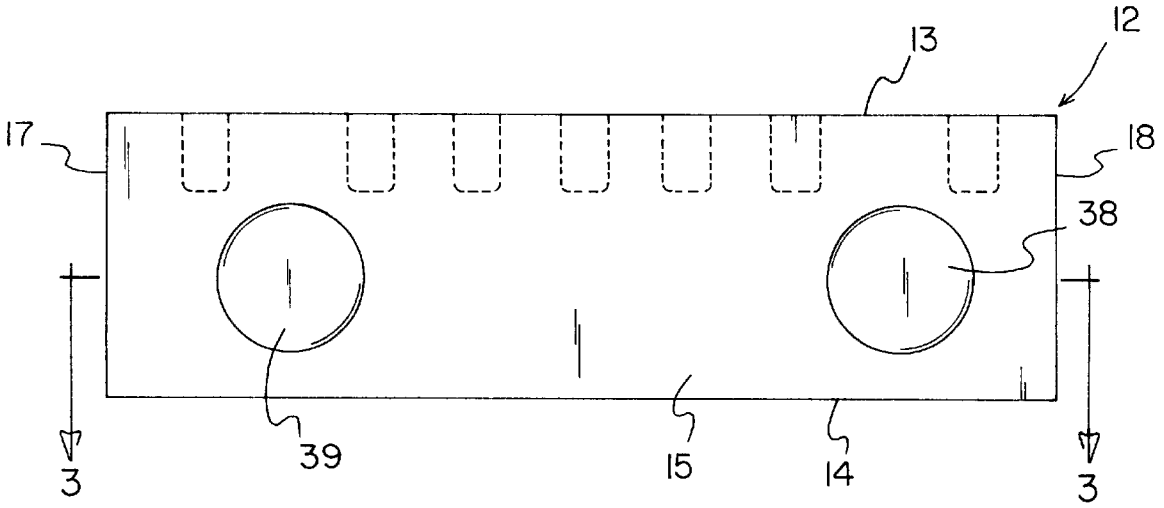
FIG. 2 is a schematic end view of the present invention.

With reference now to the drawings, and in particular to FIGS. 1 through 7 thereof, a new plastic bag holding device embodying the principles and concepts of the present invention and generally designated by the reference numeral 10 will be described.

In use, the device 10 is designed for holding open a flexible plastic bag 11 to permit filling of the bag 11. As best illustrated in FIGS. 1 through 7, the plastic bag holding device 10 generally comprises a base 12 and a plurality of elongate pegs 31,32,33. The top 13 of the base 12 has a plurality of spaced apart sockets 21,22,23,24,25,26,27,28,29,30 extending into the interior of the base 12. One of the ends of each peg is insertable into a socket such that the pegs are upwardly extended from the top 13 of the base 12. The base 12 also has a number of storage compartments 34,35,36 in the interior of the base 12 for storing the pegs when not in use.

In closer detail, the a base 12 is preferably generally rectangular and has a top 13, a bottom 14, first and second ends 15,16, and first and second sides 17,18 extending between the ends 15,16 of the base 12. The base 12 has a length defined between the ends 15,16, a width defined between the sides 17,18, and a thickness defined between the top 13 and bottom 14. In an ideal illustrative embodiment, the length of the base is about 13 inches, the width of the base is about 7 inches, and the thickness of the base is about 1½ inches.

Each of the ends and the sides of the base has a midpoint along their lengths. A first line is extended between the midpoints of the ends 15,16 of the base. A second line is extended between the midpoint of the first end 15 of the base 12 and the midpoint of the first side 17 of the base 12. A third line is extended between the midpoint of the first end 15 of the base 12 and the midpoint of the second side 18 of the base 12. A fourth line is extended between the midpoint of the second end 16 of the base 12 and the midpoint of the first side 17 of the base 12. A fifth line is extended between the midpoint of the second end 16 of the base 12 and the midpoint of the second side 18 of the base 12. A six line is extended between the midpoints of the sides of the base 12.

The top 13 of the base 12 has a plurality of spaced apart sockets 21,22,23,24,25,26,27,28,29,30 extending into the interior of the base 12. The sockets are preferably generally cylindrical. In a preferred embodiment, the depths of the sockets are less than about one-half the thickness of the base 12. Ideally, the depths of the sockets are about one-third the thickness of the base 12. A first number of sockets 21,22,23,24 are positioned along the first line. A second number of sockets 21,25,27,28 are positioned along the second line. A third number of sockets 21,26,29,30 are positioned along the third line. A fourth number of sockets 23,25,26 are positioned along the sixth line. Specifically, a first socket 21 is positioned adjacent the midpoint of the first end 15 of the base 12, that is, at the intersection of the first, second and third lines. A second socket 22 is positioned adjacent the midpoint of the second end 16 of the base 12, that is, at the intersection of the first, fourth and fifth lines. A third socket 23 is positioned along the first line adjacent the sixth line, that is, at the intersection of the first and sixth lines. A fourth socket 24 is positioned along the first line adjacent a midpoint between the first and third sockets of the first number of sockets. A fifth socket 25 is positioned adjacent the midpoint of the first side 17 of the base 12, that is, at the intersection of the second, fourth, and sixth lines. A sixth socket 26 is positioned adjacent the midpoint of the second side 18 of the base 12, that is, at the intersection of the third, fifth, and sixth lines. A seventh socket 27 is positioned along the second line adjacent a midpoint between the first and fifth sockets. An eighth socket 28 is positioned along the second line adjacent a midpoint between the first and seventh sockets. A ninth socket 29 is positioned along the third line adjacent a midpoint between the first and sixth sockets. A tenth socket is positioned along the third line adjacent a midpoint between the first and ninth sockets.

Figure 4:
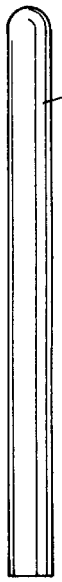
FIG. 4 is a schematic side view of a peg of the first set of pegs of the present invention.
Figure 5:
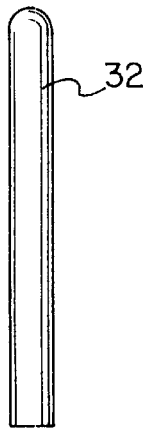
FIG. 5 is a schematic side view of a peg of the second set of pegs of the present invention.
Figure 6:
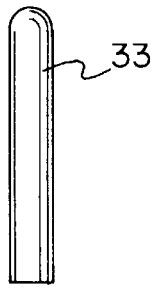
FIG. 6 is a schematic side view of a peg of the third set of pegs of the present invention.
Figure 7:
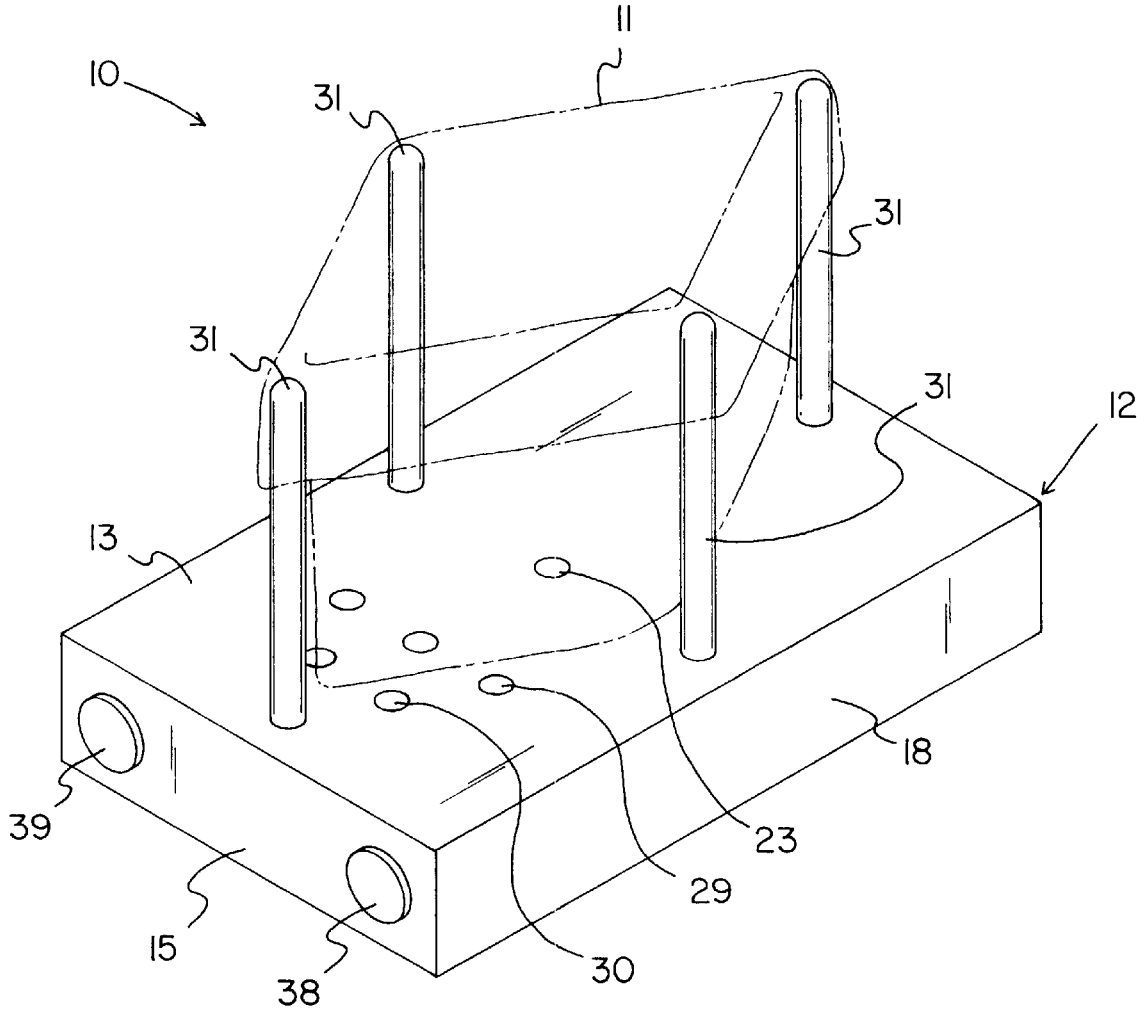
FIG. 7 is a schematic perspective view of the present invention in use holding a bag open.

The device also includes a plurality of elongate pegs 31,32,33. Each peg is generally cylindrical and has a pair of opposite ends and a length extending between the ends of the peg. As illustrated in FIG. 7, one of the ends of each of the pegs is insertable into a socket such that the pegs are upwardly extended from the top 13 of the base 12. With reference to FIG. 7, in use, the top ends of the pegs are designed for folding the top 13 opening of a plastic bag I1 over so that the plastic bag 11 is puckered open between the upwardly extending pegs. With reference to FIGS. 4,5, and 6, preferably, the plurality of pegs comprises first, second and third sets of pegs 31,32,33 with each set of pegs ideally having four pegs. As illustrated in FIGS. 4, 5, and 6, the lengths of the pegs of the first set of pegs 31 are greater than the lengths of the pegs of the second set of pegs 32 and the lengths of the pegs of the second set of pegs 32 is greater than the lengths of the pegs of the third set of pegs 33. In use, the pegs of the first set of pegs are preferably designed for insertion into the first, second, fifth, and sixth sockets 21,22,25,26 for filling large sized plastic bags 11 such as gallon freezer bag. Preferably, the pegs of the second set of pegs 32 are designed for insertion into the first, third, seventh, and ninth sockets 21,23,27,29 for filling medium sized plastic bags 11 such as quart freezer bags 11. In use, the pegs of the third set of pegs 33 are preferably designed for insertion into the first, fourth, eighth, and tenth sockets 21,24,28,30 for filling small sized plastic bags 11 such as pint freezer bags 11.

Figure 3:
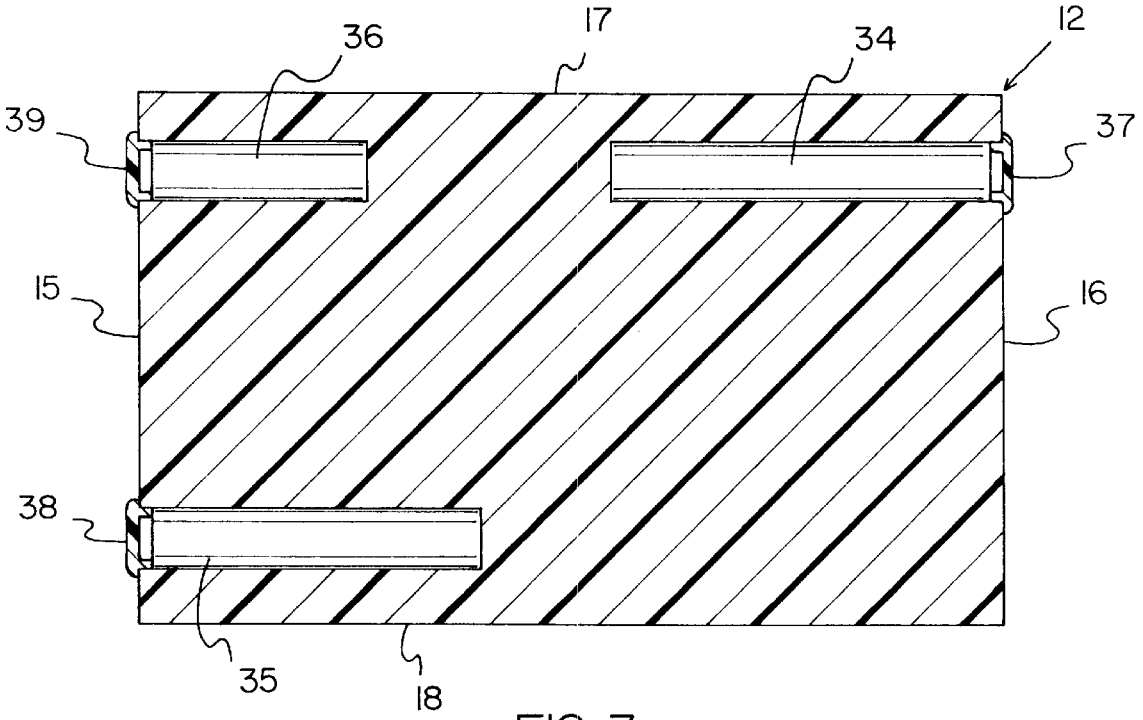
FIG. 3 is a schematic cross section view of the present invention taken from line 3—3 of FIG. 2.

The base 12 also has a number of storage compartments 34,35,36 in the interior of the base 12. Each of the storage compartments is preferably generally cylindrical and has a circular opening and a length. Preferably, the lengths of the storage compartments are less than about one-half the length of the base 12. The opening of a first of the storage compartments 34 is located on the second end 16 of the base 12. The first of the storage compartments 34 is designed for holding the pegs of the first set of pegs 31. The openings of a second and a third of the storage compartments 35,36 are located on the first end 15 of the base 12. The second of the storage compartments 35 is designed for holding the pegs of the second set of pegs 32 while the third of the storage compartments 36 is designed for holding the pegs of the third set of pegs 33. As illustrated in FIG. 3, preferably, the length of the first of the storage compartments 34 is greater than the length of the second of the storage compartments 35 and the length of the second of the storage compartments 35 is greater than the length of the third of the storage compartments 36. Each storage compartments preferably has a removable cap 37,38,39 closing the associated opening of the storage compartment.

In use, one end of each of the pegs of the desired set of pegs are inserted into the appropriate sockets in the base. The bottom of a plastic bag is placed on the top of the base between the inserted pegs. As illustrated in FIG. 7, the top of the bag is folded over the top ends of said inserted pegs so that the opening of the bag is held open by the pegs so that the bag may be filled.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for holding open a flexible bag, said device comprising:

a base having an interior, a top, a bottom, first and second ends, and first and second sides extending between said ends of said base;

said top of said base having a plurality of spaced apart sockets extending into said interior of said base a plurality of elongate pegs, each peg having a pair of opposite ends and a length extending between said ends of said peg, one of said ends of each of said pegs being insertable into a socket such that the pegs are upwardly extended from said top of said base, said plurality of pegs comprising first, second and third sets of pegs, wherein said lengths of the pegs of said first set of pegs being greater than said lengths of the pegs of said second set of pegs, and wherein said lengths of the pegs of said second set of pegs being greater than said lengths of the pegs of said third set of pegs; and said base having a number of storage compartments in said interior of said base, each of said storage compartments has an opening therein.

2. The device of claim 1, wherein said base has a length defined between said ends of said base, wherein said base has a width defined between said sides of said base, and wherein said base has a thickness defined between said top and bottom of said base.

3. The device of claim 2, wherein said sockets has a depth, wherein said depths of said sockets are less than about one-half said thickness of said base.

4. The device of claim 2, wherein each of said storage compartments has a length, wherein said lengths of said storage compartments are less than about one-half said length of said base.

5. The device of claim 1, wherein the opening of a first of said storage compartments is located on said second end of said base, wherein the openings of a second and a third of said storage compartments are located on said first end of said base.

6. The device of claim 5, wherein said length of said first of said storage compartments is greater than said length of said second of said storage compartments, wherein said length of said second of said storage compartments is greater than said length of said third of said storage compartments.

7. A device for holding open a flexible bag, said device comprising:

a base being generally rectangular and having an interior, a top, a bottom, first and second ends, and first and second sides extending between said ends of said base;

said base having a length defined between said ends of said base;

said base having a width defined between said sides of said base;

said base having a thickness defined between said top and bottom of said base;

each of said ends of said base having a midpoint, each of said sides of said base having a midpoint;

said top of said base having a plurality of spaced apart sockets extending into said interior of said base, said sockets being generally cylindrical and having a depth, wherein said depths of said sockets are less than about one-half said thickness of said base, wherein said depths of said sockets are about one-third said thickness of said base;

a plurality of elongate pegs, each peg being generally cylindrical and having a pair of opposite ends and a length extending between said ends of said peg, one of said ends of each of said pegs being insertable into a socket such that the pegs are upwardly extended from said top of said base;

wherein said plurality of pegs comprises first, second and third sets of pegs, wherein each set of pegs comprises four pegs;

said lengths of the pegs of said first set of pegs being greater than said lengths of the pegs of said second set of pegs, said lengths of the pegs of said second set of pegs being greater than said lengths of the pegs of said third set of pegs;

said base having a number of storage compartments in said interior of said base, each of said storage compartments being generally cylindrical and having an opening and a length;

wherein said lengths of said storage compartments are less than about one-half said length of said base;

the opening of a first of said storage compartments being located on said second end of said base;

the openings of a second and a third of said storage compartments being located on said first end of said base;

wherein said length of said first of said storage compartments is greater than said length of said second of said storage compartments, wherein said length of said second of said storage compartments is greater than said length of said third of said storage compartments; and each storage compartments having a removable cap closing the associated opening of the storage compartment.

* * * * *